US009002539B2

(12) United States Patent
Kaiser

(10) Patent No.: US 9,002,539 B2
(45) Date of Patent: Apr. 7, 2015

(54) VEHICLE OPERATED IN A SELF-PROPELLED PROGRAM-CONTROLLED MANNER FOR MEASURING, MARKING AND AT LEAST PRE-PUNCHING OR PRE-DRILLING HOLES FOR FOUNDATION DEVICES

(75) Inventor: Franz Kaiser, Strasskirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 0 days.

(21) Appl. No.: 14/236,148

(22) PCT Filed: Jul. 25, 2012

(86) PCT No.: PCT/EP2012/064604

§ 371 (c)(1),
(2), (4) Date: Jan. 30, 2014

(87) PCT Pub. No.: WO2013/020812

PCT Pub. Date: Feb. 14, 2013

(65) Prior Publication Data

US 2014/0172199 A1 Jun. 19, 2014

(30) Foreign Application Priority Data

Aug. 5, 2011 (DE) ..... 10 2011 109 654

(51) Int. Cl.
*E02F 9/20* (2006.01)
*E02D 7/02* (2006.01)
*E02D 7/22* (2006.01)

(52) U.S. Cl.
CPC ..... *E02F 9/2025* (2013.01); *E02D 7/02* (2013.01); *E02D 7/22* (2013.01)

(58) Field of Classification Search
CPC ..... E02D 7/02; E02D 9/2025; E02D 7/22
USPC ..... 701/2
See application file for complete search history.

(56) References Cited

U.S. PATENT DOCUMENTS 8,585,327 B2 * 11/2013 Thurner et al. ..... 405/232
8,606,540 B2 * 12/2013 Haisty et al. ..... 702/157

(Continued)

FOREIGN PATENT DOCUMENTS

DE 102008022478 B3 10/2009
WO WO-2009055955 A1 5/2009

OTHER PUBLICATIONS

German Office Action for Application No. 10 2011 109 6654.3 dated May 15, 2012.

(Continued)

*Primary Examiner* — Mary Cheung
*Assistant Examiner* — Anne Mazzara
(74) *Attorney, Agent, or Firm* — Marshall, Gerstein & Borun LLP

(57) ABSTRACT

A vehicle operated in a self-propelled program-controlled manner, in particular without a driver, for automatically measuring, marking and/or pre-drilling predetermined desired positions for foundation devices to be introduced into the ground, possibly also for introducing the foundation devices themselves. The vehicle includes a working device, which can be pivoted about pivoting axes and is equipped with a device for automatically detecting and correcting misalignments of the axis thereof and which brings the vehicle to the desired positions with a locating device, which establishes the actual position thereof, and a data processing system, which is loaded with the desired positions in such a way that it can perform the prescribed working steps in a program-controlled manner.

11 Claims, 3 Drawing Sheets

(56) References Cited

U.S. PATENT DOCUMENTS

| | | | | |
|---|---|---|---|---|
| 2005/0200523 | A1* | 9/2005 | Durban et al. | 342/359 |
| 2009/0290940 | A1 | 11/2009 | Martin, Sr. | |
| 2011/0091285 | A1* | 4/2011 | Thurner et al. | 405/184.4 |

OTHER PUBLICATIONS

International Search Report Application No. PCT/EP2012/04604 dated Nov. 2, 2012.

* cited by examiner

VEHICLE OPERATED IN A SELF-PROPELLED PROGRAM-CONTROLLED MANNER FOR MEASURING, MARKING AND AT LEAST PRE-PUNCHING OR PRE-DRILLING HOLES FOR FOUNDATION DEVICES

CROSS-REFERENCE TO RELATED APPLICATIONS

This is the U.S. National Stage of International Patent Application No. PCT/EP2012/064604, which has an international filing date of Jul. 25, 2012, and claims priority benefit of German patent application no. 10 2011 109 654.3, filed Aug. 5, 2011. The entire contents of each of the foregoing are hereby incorporated herein by reference.

FIELD OF DISCLOSURE

The present disclosure relates to a vehicle operated in a program-controlled, in particular driverless, self-propelled manner for automatically measuring predetermined desired positions for foundation devices to be introduced into the ground for automatically marking the measured predetermined desired positions, if applicable also for removing the markings once more, and/or for automatically pre-punching (pre-drilling) holes in the ground for introducing the foundation devices at the measured predetermined desired positions, and if applicable also for automatically introducing (setting), in particular hammering or screwing, foundation devices into the ground at the measured predetermined desired positions.

BACKGROUND

Apparatuses for pre-punching (pre-drilling) holes for introducing foundation devices and for introducing the foundation devices themselves into the ground are known. In the simplest case, they are maneuvered by the operator into the position in which pre-punching (pre-drilling) is to take place or the foundation devices are to be set.

There are special requirements when groups of foundation devices are to be set, for example rows with consistent spacing. Here, in the simplest case, the operator orients himself with respect to a specified boundary line, for example—when setting foundation devices for road boundary posts—with respect to the edge of the carriageway, wherein the determination of the required, defined, more or less consistent spacing requires an additional measurement. In doing so, in case of doubt, the person entrusted with measuring the spacing will mark the measured positions in preparation for the subsequent working steps.

If there are no such guides—in open country for example—they can be replaced by other aids, for example by establishing orientation lines and points using theodolites. However, this requires significant effort, particularly when not only single rows of foundation devices but whole fields are to be set, such as frequently occurs today, for example, when installing photovoltaic systems in open country.

Theoretically, here too the positions of the (possibly hundreds of) foundations can be measured individually. However, the effort required for this is immense. In addition, the support for such systems requires a precision and in particular an accuracy of positioning of the foundations which can only be maintained with difficulty using conventional measuring methods.

This may still be feasible when such a system is to be erected in flat terrain, as the foundations are then to be positioned on a rectangular grid which is still relatively easy to measure on a flat surface.

However, this becomes considerably more difficult when the support is to be installed in uneven terrain, such as is increasingly required today in light of the amount of land taken up by such systems. This is because, under certain circumstances, the positions of the foundations then stray from the rectangular grid and instead are relocated—depending on the slope of the terrain—to a more or less pronounced, irregular diamond pattern, such as that which the applicant has made the subject of its application DE 10 2010 005 098.9.

This means that, in such a case, every single foundation position actually has to be calculated and individually measured based on a recorded terrain profile.

Here, the calculation of the foundation positions based on a terrain profile using a suitable electronic data processing program presents no problems in itself. In this regard, reference can also be made to the applicant's own application previously mentioned. However, the measurement of the calculated positions in the terrain is extremely laborious and subject to error.

Today, this is usually carried out with the help of a satellite-controlled plumb rod, which the operator has to position at the indicated point on the ground.

However, inaccuracies, which are perpetuated when the located positions are then marked—for example with the help of a hammered-in peg—, occur even with this method. Further sources of error are added when the peg is then removed for pre-punching (pre-drilling) the hole for the foundation, and the pre-punching (pre-drilling) apparatus and/or the foundation to be introduced are positioned more or less precisely.

All in all, this can lead to deviations which far exceed the acceptable tolerances for erecting such systems.

GENERAL DESCRIPTION

This results in the object of specifying a vehicle which reliably and quickly measures predetermined (calculated) desired positions for foundation devices to be introduced into the ground in the terrain with the lowest possible tolerance, and also quickly and reliably carries out the further steps (marking, pre-punching, if applicable also the setting of the foundation devices themselves) necessary for introducing the foundation devices while extensively eliminating avoidable intermediate steps and sources of error.

The vehicle is a program-controlled, in particular in a driverless manner, self-propelled vehicle which approaches its desired positions, i.e. the points at which markings are to be set or if applicable removed once more or foundation devices set or holes for said foundation devices pre-punched, independently and automatically, particularly without intervention of an operator, and also carries out the further work steps to be undertaken there, if applicable up to the introduction of the foundation itself, independently and automatically.

Within the meaning of this present disclosure, the term "program-controlled, in particular in a driverless manner, self-propelled vehicle" is understood to mean a vehicle that is controlled, so to speak, as a vehicle with autopilot. When the autopilot is switched on, the automatic system undertakes the control of the vehicle with regard to direction and speed to the respective desired positions to be approached. The vehicle does this, even if an operator is still seated in the driver's cab. For safety reasons, it is in any case preferred that the driver's cab is occupied in spite of the autopilot. Incidentally, this is also borrowed from the occupation of the cockpit of an aircraft which, as is known, is often controlled with an autopilot without the cockpit being devoid of people. The operator sitting in the driver's cab only interferes with the automatic system in special situations. These may be unforeseen obstructions, boundaries or possibly also a failure of the automatic system, i.e. of the autopilot.

This means that the vehicle automatically and in a program-controlled manner measures and if applicable marks the predetermined positions for the foundation devices to be introduced into the ground in the terrain, if applicable also removes the markings for introducing the pre-punching (pre-drilling) device and the foundation devices themselves, further if applicable automatically and in a program-controlled manner actuates a device for pre-punching (pre-drilling) holes in the ground for introducing the foundation devices at the measured predetermined positions, and/or finally sets into operation an apparatus for hammering or screwing foundation devices into the ground at the measured predetermined, if applicable pre-drilled positions.

For this purpose, the vehicle, for example a tracked vehicle, has a working device. The working device can optionally be designed only for measuring and marking the measured predetermined desired positions; however, if necessary, it can also undertake the removal of the marking, for example of hammered-in or screwed-in pegs, which would be in the way of the further working steps.

Alternatively or in addition, the working device can also be designed for measuring and pre-punching (pre-drilling) holes in the ground for introducing the foundation devices at the measured predetermined desired positions.

Finally, the working device can be designed as an apparatus for measuring and for hammering or screwing the foundation devices into the ground at the measured predetermined, if applicable pre-punched (pre-drilled) desired positions.

Here, it is understood that the marking of the predetermined position can be omitted if, instead, pre-punching (pre-drilling) is carried out directly, and that also pre-punching (pre-drilling) is not always necessary, for example if the soil is light, and in such a case the foundation is only hammered-in or screwed-in at the measured predetermined point, in which case the parts of the working device which are not required can be dispensed with.

Conversely, it is understood that the working device can also be restricted to marking, possibly with the removal of the marker, and/or to pre-punching (pre-drilling) if appropriate equipment is provided for the further steps, for example for screwing-in at the marked points.

In summary, it can be stated that, depending on the requirements, the working device can have different components which can also be held available, possibly in the form of additional equipment for replacement depending on the intended use, or as interchangeable equipment in the manner of a turret design, wherein, however, in each case, the apparatus combines the program-controlled automatic measurement of the predetermined positions with at least one component of the working device (for marking or pre-punching (pre-drilling) or introducing the foundation device).

As a rule, the foundation devices to be introduced must be introduced vertically into the ground. The same applies accordingly for the pre-punched (pre-drilled) holes, which only prepare and simplify the introduction of the foundation device and must be correspondingly identically aligned. For practical reasons, the same also applies for pegs which are to be introduced as markers.

However, it can also be required to set the foundation devices and correspondingly the pre-punched (pre-drilled) holes with a predetermined inclination.

To enable this intended inclination to be also maintained in the event that the vehicle is leaning, which is often the case in open country, the working device is fitted to the vehicle with a bearing which enables it to pivot in the longitudinal and the transverse axis of the vehicle in such a way that misalignments of the longitudinal axis of the working device, which occur due to a longitudinal or lateral inclination of the vehicle in the terrain, can be corrected.

To enable the correction to be carried out automatically at all times when the equipment is used, the apparatus is fitted with a device for automatically detecting and correcting such misalignments. For this purpose, tilt sensors can easily be provided on the working device or on the vehicle, the signals of which are used to correct the axis of the working device.

In a particularly advantageous embodiment, the tilt sensors used are so-called gyroscopic inclination sensors. These tilt sensors are able to provide information relating to all six degrees of freedom. These are sensors for measuring straight-line accelerations in the direction of the x, y and z-axis and sensors for detecting rotational accelerations about the x, y and z-axes. To enable the information from all sensors relating to the six degrees of freedom to be evaluated reliably, gyroscopic tilt sensors of this kind have a logic circuit or a calculation unit internally. The device for automatically detecting and correcting the misalignments can be designed in different configurations. Preferably, such a tilt sensor is attached to the vehicle, and in addition two angle sensors are provided for the two pivot axes of the working device. In this way, it is possible to always arrange the working device pointing towards the center of the Earth, i.e. vertically or in some other desired axis direction, by taking into account the inclination of the vehicle.

However, it is also possible for a tilt sensor to be arranged on the working device, wherein an angle sensor is in each case associated with a pivot axis of the working device. With this configuration, the angle sensors for the pivot axes of the working device are able and are also used to determine the corresponding angle deviations with respect to the vehicle. In this way, it is also possible to align the working device pointing towards the center of the Earth, i.e. vertically or in some other desired axis direction.

According to a third configuration, an angle sensor is in each case provided on the vehicle and on the working device. In this case, it is no longer necessary to provide the pivot axes of the working device with angle sensors.

Furthermore, the apparatus according to the present disclosure has a locating device for determining the actual position (position coordinates) of the working device in the terrain. This can be designed in the known manner as a terrestrial device, but today, for convenience, will be one of the common satellite-assisted positioning units (GPS, GNSS) which comply outstandingly with the accuracy requirements for setting the foundation devices for photovoltaic systems and the like, as in the meantime, with appropriate design including appropriate software, they work with an accuracy of +/−1 cm and better.

Preferably, according to the present disclosure, two GPS antennas are provided for the vehicle. Here, one GPS antenna is used to determine the position of the vehicle, and the second GPS antenna indicates the direction in which the vehicle is standing. In principle, a single antenna would be sufficient for the movement of the vehicle. However, the second antenna simplifies the exact determination of the vehicle in space.

The use of such a satellite-assisted positioning device also lends itself, as it provides the position coordinates of the working device in the form of data which the also provided data processing system is capable of processing.

This data processing system controls the vehicle automatically, in particular in a driverless manner, in such a way that the working device is moved to the particular working position. That is to say the data processing system controls the vehicle so that the actual position of the working device is moved to coincide with the particular predetermined desired position in which it can carry out the intended working steps for the introduction of the foundation device at the measured predetermined point (marking, if applicable removing the marker, and/or pre-punching/pre-drilling and/or introducing the foundation devices).

The predetermined desired positions in the terrain for the foundation devices to be introduced into the ground are forwarded to the data processing system for this purpose.

As, if required, work is carried out here with a satellite-assisted locating device with an accuracy of +/−1 cm, the apparatus achieves a practically pinpoint positioning of the foundations, such as is required for special purposes such as the supports of photovoltaic systems.

This applies particularly when—as is common with such systems—the foundations are to be introduced vertically and any misalignments due to the vehicle leaning have been previously corrected, as is provided according to the present disclosure. The apparatus then works with practically pinpoint accuracy and free from errors.

If, exceptionally, it should be required to introduce foundation devices in an inclined position which deviates from the vertical, then, with appropriate programming of the data processing system, the apparatus according to the present disclosure can also satisfy this. In this case, in order to ensure a pinpoint alignment of the working device at the specified desired position, it is then indeed necessary for the inclined position to be taken into account in the computer program and for it to be thus ensured that the axis of the working device, when in use, runs exactly through the particular desired position.

The vehicle can then approach the desired positions without error without the need for readjustment by means of the working device. According to the present disclosure, such a readjustment is therefore only provided as an option in the form of a device which, in addition to the pivoting of the working device to correct its axis, provides a horizontal movement of the working device in the longitudinal and transverse direction for fine matching of the actual to the desired position.

In order to detect and correct misalignments of the longitudinal axis of the working device and, if necessary, also to finely adjust the working device to its particular desired position, the vehicle or the working device can be provided with their own devices independent from the data processing system. However, these can also be integrated into the data processing system.

BRIEF DESCRIPTION OF THE DRAWINGS

The subject matter of the present disclosure is described in more detail below with reference to the drawings. In the drawings.

DETAILED DESCRIPTION

Figure 1:
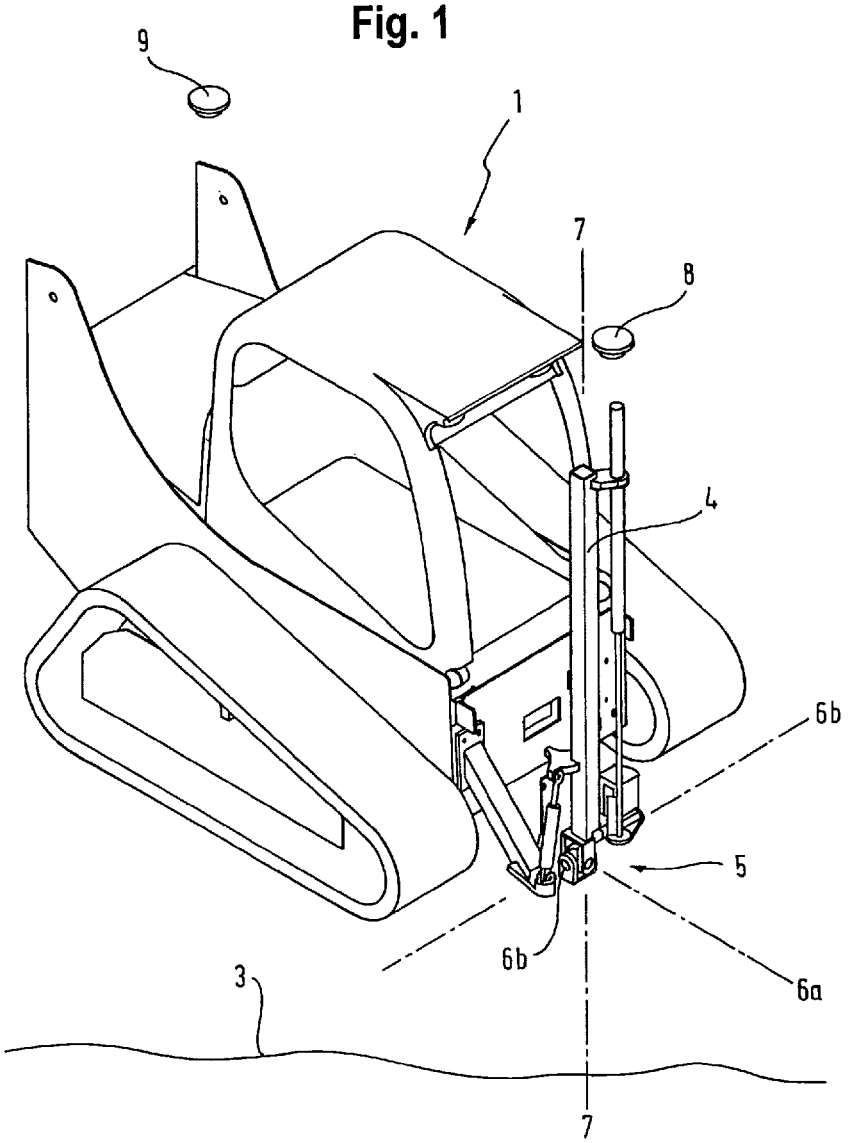
FIG. 1 shows the vehicle 1 for automatically measuring, marking and pre-punching (pre-drilling) predetermined desired positions for foundation devices in the terrain in a perspective view.

FIG. 1 shows the vehicle 1 for automatically measuring, marking and pre-punching (pre-drilling) predetermined desired positions for foundation devices in the terrain 3 in a perspective view. The working device 4, which has a bearing 5 on the vehicle 1, by means of which it can be pivoted about the pivot axes 6*a* and 6*b* in order to align its axis 7, is shown. A device 8 detects misalignments and controls their correction. A locating device 9 determines the actual position of the working device 4, and, based on the predetermined data assigned thereto, a data processing system (not shown) steers the working device 4 into the desired positions, i.e. into the positions in which the axis 7 of the working device 4 intersects the desired positions, thus enabling the working device 4 to carry out the intended working steps with pinpoint accuracy.

Figure 2:
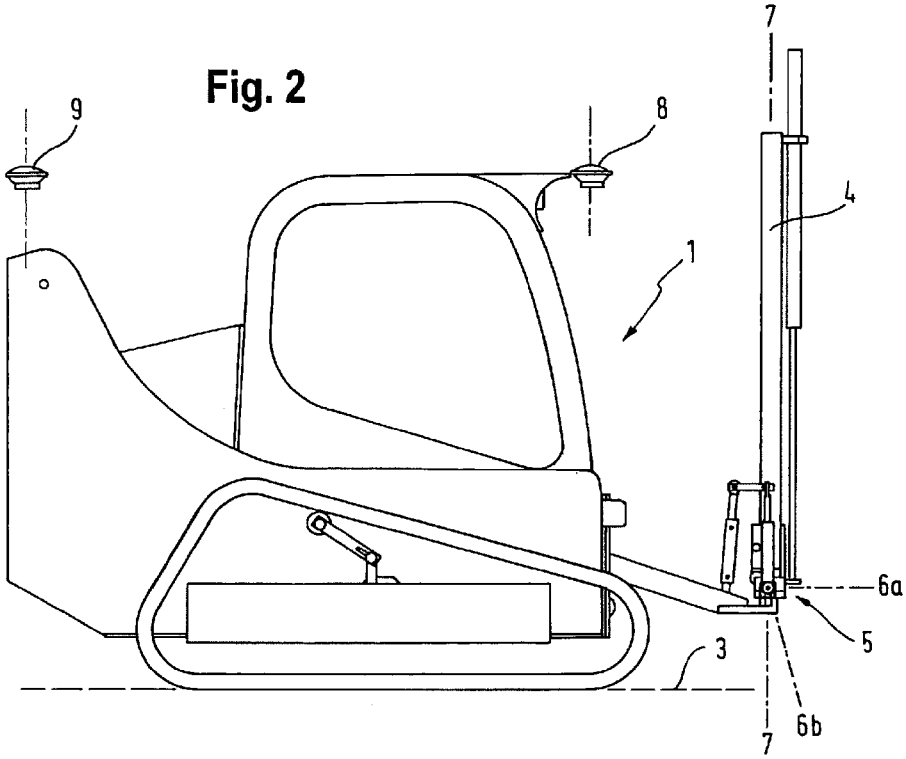
FIG. 2 shows the vehicle according to FIG. 1 in a side view.

FIG. 2 shows the vehicle 1 according to FIG. 1 in a side view with all the details already mentioned.

Figure 3:
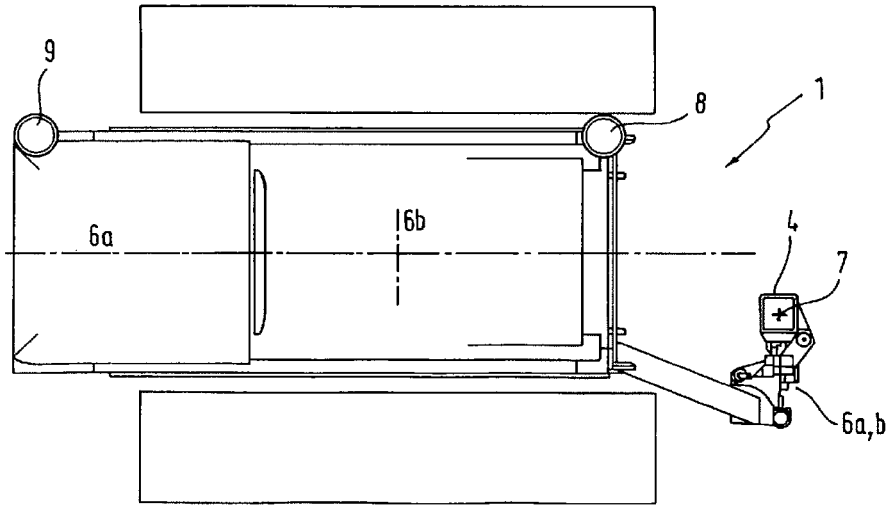
FIG. 3 shows the vehicle in plain view.

FIG. 3 shows the vehicle 1 in plain view with all the details already mentioned.

Figure 4:
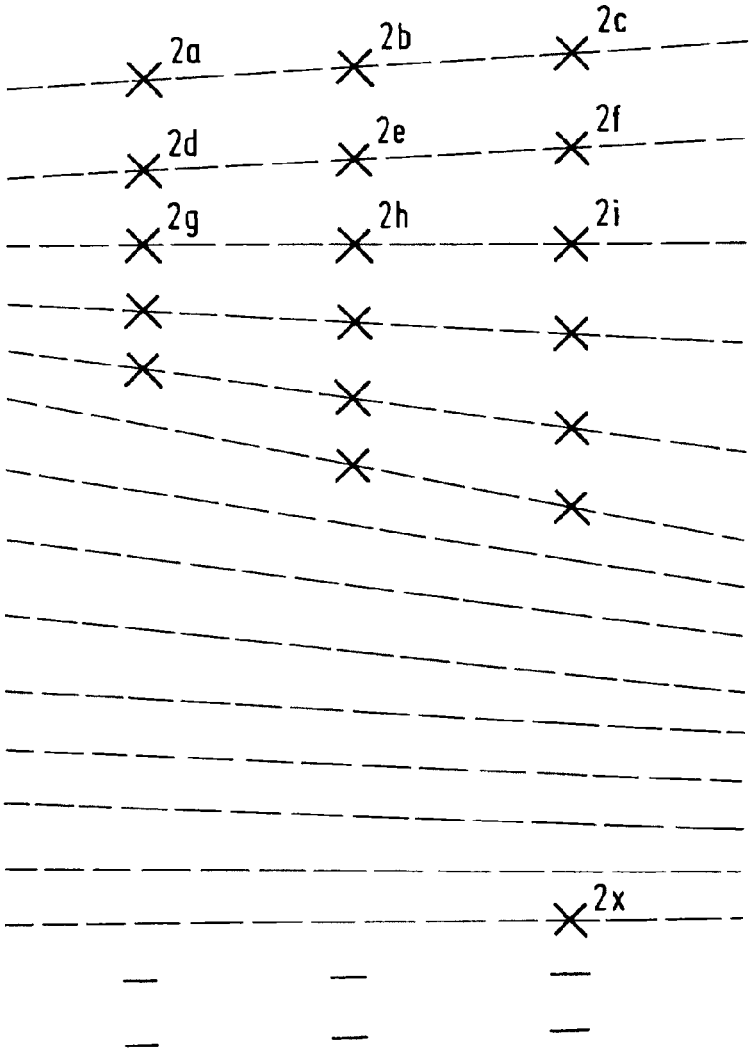
FIG. 4 shows a grid of desired positions 2*a-x*.

FIG. 4 shows a grid of desired positions 2*a-x*, such as are obtained, for example, when the desired positions of the supports of a photovoltaic system which is erected at an angle in uneven terrain are determined by dropping the plumb bob from its upper attachment points to the ground, as proposed by the applicant in the earlier application mentioned.

The grid indicates only schematically and with no claim to mathematical accuracy how, in this case, a multiplicity of desired positions, which do not follow a simple mathematical principle, are obtained, for example are not laid out as a rectangular structure, but follow other, more complex laws and are accordingly more difficult to determine (to calculate) and to measure.

The invention claimed is:

1. A vehicle, which is self-propelled in a program-controlled, in particular driverless, manner, for automatically measuring, marking with markers and pre-punching, in particular pre-drilling, predetermined desired positions for foundation devices in the terrain, the vehicle comprising: a working device for marking the desired positions, for removing the markers, and/or for pre-punching, in particular pre-drilling, holes for introducing the foundation devices into the ground at the desired positions, having a bearing of the working device which enables it to be pivoted about a longitudinal and transverse axis in such a way that misalignments of the axis of the working device, which occur due to a longitudinal and/or lateral inclination of the vehicle in the terrain, can be corrected, and having a device for automatically detecting and correcting such misalignments, further having a locating device for determining the actual position of the working device and having a data processing system which controls the vehicle in such a way that the actual position of the working device is in each case moved to coincide with the desired positions, and which steers the working device into these positions when carrying out the specified working steps.

2. The vehicle according to claim 1, wherein the working device for introducing the foundation device is in the form of a further working step.

3. The vehicle according to claim 2, wherein the working device for introducing the foundation device is a working device for hammering-in or screwing-in the foundation device.

4. The vehicle according to claim 1, wherein the bearing for finely matching the actual position to the desired positions provides a capability of moving the working device in the direction of the longitudinal and transverse axis.

5. The vehicle according to claim 1, wherein the device for automatically detecting and correcting misalignments of the axis of the working device and a device for finely matching the actual position to the desired positions are part of the data processing system.

6. The vehicle according to claim 1, wherein the location device is a satellite positioning system with an accuracy >+/−1 cm.

7. The vehicle according to claim 1, wherein the location device is a tachymeter.

8. The vehicle according to claim 7, wherein the location device is remote-controlled.

9. The vehicle according to claim 1, wherein a tilt sensor is provided on the vehicle or on the working device, and an angle sensor is provided for each of the pivot axes of the working device.

10. The vehicle according to claim 9, wherein the tilt sensor evaluates all six degrees of freedom.

11. The vehicle according to claim 1, wherein a tilt sensor is provided on the vehicle and on the working device.

* * * * *